US006360073B1

(12) United States Patent
Eelen

(10) Patent No.: US 6,360,073 B1
(45) Date of Patent: Mar. 19, 2002

(54) APPARATUS AND METHOD FOR FIXING TONER IMAGES ONTO A RECORDING MEDIUM

(75) Inventor: Peter Eelen, Zoersel (BE)

(73) Assignee: Xeikon NV, Mortsel (BE)

( * ) Notice: Subject to any disclaimer, the term of this patent is extended or adjusted under 35 U.S.C. 154(b) by 0 days.

(21) Appl. No.: 09/702,158

(22) Filed: Oct. 30, 2000

(30) Foreign Application Priority Data

Oct. 30, 1999 (GB) ..... 99257438

(51) Int. Cl.[7] ..... G03G 15/20; G03G 15/16
(52) U.S. Cl. ..... 399/327; 399/307
(58) Field of Search ..... 399/101, 307, 399/327, 343, 357, 308

(56) References Cited

U.S. PATENT DOCUMENTS

| | | | | |
|---|---|---|---|---|
| 4,000,963 A | * | 1/1977 | Thettu | 399/327 |
| 4,013,400 A | | 3/1977 | Thettu et al. | |
| 4,018,555 A | * | 4/1977 | Thettu | 399/327 |
| 4,607,947 A | * | 8/1986 | Ensing et al. | 399/308 |
| 4,705,388 A | * | 11/1987 | Huntjens et sl. | 399/24 |
| 5,455,668 A | | 10/1995 | De Bock et al. | |
| 5,597,413 A | | 1/1997 | Kromm, Jr. | |
| 5,678,134 A | * | 10/1997 | Miki et al. | 399/327 X |
| 5,805,967 A | | 9/1998 | De Bock et al. | |
| 5,893,018 A | | 4/1999 | De Bock et al. | |
| 6,226,489 B1 | * | 5/2001 | Eelen et al. | 399/327 |

FOREIGN PATENT DOCUMENTS

| | | | |
|---|---|---|---|
| EP | 149 860 | | 3/1988 |
| GB | 2 284 913 A | | 6/1995 |
| JP | 2-188332 | * | 7/1990 |
| WO | WO 98/36331 | | 8/1998 |

* cited by examiner

*Primary Examiner*—Joan Pendegrass
(74) *Attorney, Agent, or Firm*—Knobbe Martens Olson & Bear LLP

(57) ABSTRACT

A fixing device for fixing toner images onto a recording medium comprises an endless fixing member urged into contact with an endless counter member to form a fixing nip there between through which the recording medium passes. A cleaning roller has a surface in contact with the fixing member downstream of the fixing nip, the surface carrying a layer of tacky cleaning material. A controllable applicator unit continuously provides fresh cleaning material to the cleaning roller. A spindle contacts the cleaning roller surface for transporting the fresh cleaning material from the applicator unit across the roller and for transporting the contaminated tacky cleaning material towards an edge of the cleaning roller. Improved removal of debris is thereby possible.

10 Claims, 4 Drawing Sheets

APPARATUS AND METHOD FOR FIXING TONER IMAGES ONTO A RECORDING MEDIUM

BACKGROUND OF THE INVENTION

1. Field of the Invention

The present invention is directed to a fixing device for fixing toner images onto a receiving material, and to a method of removing debris from the surface of an endless fixing member of such a fixing device.

2. Description of the Related Art

In an electronic printer, where toner particles are deposited on a surface in image form and are subsequently transferred to a receiving material, such as paper, the toner particles must be fixed onto the receiving material in order to render the images permanent. This fixing process is often achieved by a combination of heat and pressure applied in a fixing nip. For example, the receiving material, onto which unfixed toner particles have already been deposited, is passed through the fixing nip where an increased temperature and pressure serve to fix the image permanently to the receiving material. Alternatively, a transfer surface carrying the unfixed toner particles is fed through the fixing nip together with the receiving material, whereby the increased temperature and pressure cause the transfer of the toner particles from the transfer surface to the receiving material and the simultaneous fixing of the toner image thereon.

Particularly when the recording medium is paper or a fibrous material, debris in the form of dust and/or fibers, or other impurities can be transferred back from the recording medium to the transfer surface. Together with possible residual toner particles, these debris and other impurities are referred to herein as contaminants. The contaminants negatively affect the transfer properties and the overall lifetime of the transfer surface and can result in a severe image quality degradation. Furthermore, in constructions in which the transfer surface is in contact with the photoreceptor of an image forming station directly or by way of one or more further transfer members, the situation might even get worse as these contaminants might transfer back to the photoreceptor. Consequently to assure high quality printing, the cleaning of the transfer surface is important.

A fixing device is known, for example from European patent specification EP 149860 (Océ-Nederland BV) for fixing toner images onto a receiving material. The device comprises a fixing roller urged into contact with a pressure roller to form a fixing nip there-between through, which a copy sheet passes. A perforated cleaning roller is in contact with the surface of the fixing roller to remove debris therefrom. Toner particles are applied to the cleaning member to render the surface tacky. A disadvantage of this arrangement is that due to the interrupted surface of the cleaning roller, caused by the perforations, several revolutions are required to ensure that each part of the fixing roller is contacted by the tacky surface.

In a fixing device described in U.S. Pat. No. 4,018,555 (Thettu/Xereox Corpotation), a fuser roller is urged into contact with a backup roller to form a fixing nip there between through which copy paper or substrate material passes. An internally heated cleaning roller having a tacky surface is positioned in contact with the surface of the fixing roller remove debris therefrom. The cleaning roller can be rejuvenated by the application thereto of a tacky polymeric adhesive.

U.S. Pat. No. 4,705,388 (Huntjens et al./Océ-Nederland BV) describes a method and apparatus for determining when a layer of tacky material present on a cleaning roller needs to be rejuvenated. The period rejuvenation of the tacky layer described in this patent is found to lead to inconsistent cleaning characteristics and/or a build up of excess tacky material on the cleaning roller.

U.S. Pat. No. 4,013,400 (Thettu et al./Xerox Corporation) describes a cleaning apparatus for a heat and pressure fuser. A cleaning roller having a tacky surface contacts the fuser roller to remove contaminants therefrom. Polymer material is applied to the cleaning roller from a moving web.

We have found that the above mentioned fixing devices are not as successful at removing debris from the fixing nip as may be desired for high quality work. In particular, these prior proposals do not provide for the effective removal of contaminants form the cleaning roller, thereby limiting the lifetime of the cleaning roller.

Thus it is an object of the present invention to provide a device and method in wich an improved removal of debris is possible. In particular, it is an object of the present invention to improve the overall transfer efficiency and image quality by removing impurities, which are transferred back from the recording medium. It is a further object of the present invention to increase the uptime of the print engine or copier by in-situ and continuously rejuvenating the tacky surface of the cleaning roller by providing refreshment material and simultaneously removing excess and/or contaminated tacky surface material therefrom.

SUMMARY OF THE INVENTION

In one embodiment of the invention, the fixing device for fixing toner images onto a recording medium comprises an endless fixing member urged into contact with an endless counter member to form a fixing nip there between through which a recording medium path extends, a cleaning roller having a surface in contact with the surface of the fixing member downstream of the fixing nip, the surface carrying a layer of tacky cleaning material, a controllable applicator unit for continuously providing fresh cleaning material to the cleaning roller, and a spindle contacting the cleaning roller surface for transporting the fresh cleaning material from the applicator unit across the roller and for transporting the contaminated tacky cleaning material towards an edge of the cleaning roller.

In another embodiment, the invention comprises a method of removing contaminants from the surface of an endless fixing member of a fixing device in which the fixing member is urged into contact with a counter member to form a fixing nip there between through which the recording medium passes comprising contacting the fixing member surface at a cleaning nip with a cleaning roller having a tacky surface layer of cleaning material, thereby to transfer contaminants from the fixing member to the tacky surface, continuously applying fresh cleaning material to the cleaning roller to rejuvenate the tacky surface, and contacting the cleaning roller surface with a revolving spindle to distribute the fresh cleaning material across the cleaning roller and to transport the contaminated cleaning material to an edge of the cleaning roller.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
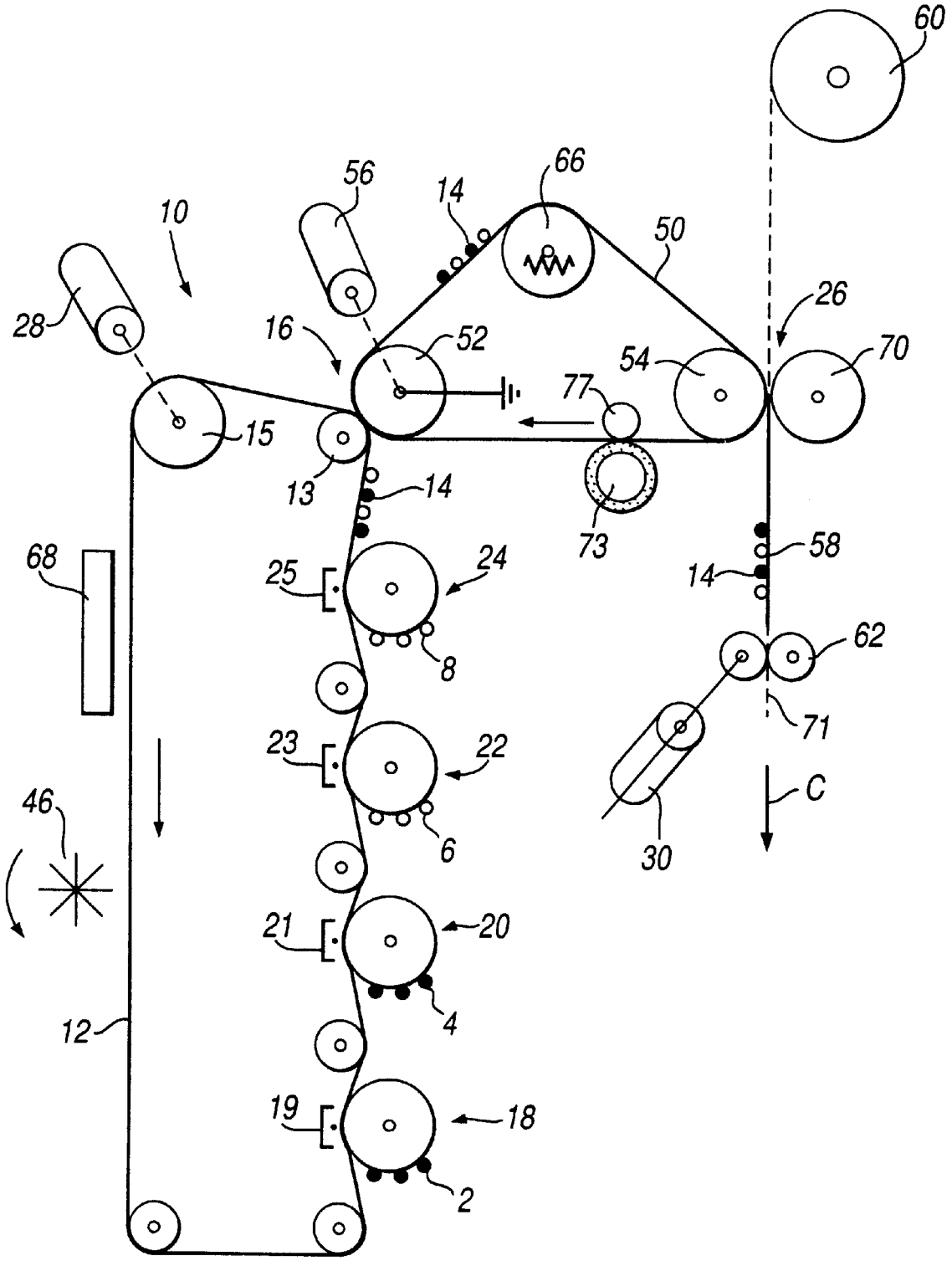
FIG. 1 is a schematic illustration of a printer according to the invention.

FIG. 1 illustrates a printer 10 according to the invention. The printer 10 includes a primary transfer belt 12 in contact with a fixing member 50 at a transfer station 16. Downstream of transfer station 16, the fixing member 50 contacts a substrate 58 at a transfer station, referred to below as simply the fixing nip 26, thereby depositing a toner image 14 thereon.

A plurality of toner image-forming stations 18, 20, 22, 24 are spaced along one run of the primary transfer belt 12. Each of the image-forming stations 18, 20, 22, 24 is similar to those described in U.S. Pat. No. 5,893,018, and include a corona discharge unit 19, 21, 23, 25, to electrostatically deposit a toner image 2, 4, 6, 8 onto the primary transfer belt 12. The primary transfer belt 12 may be formed of polyethylene terephthalate (PET) having a thickness of 100 $\mu$m.

The plurality of developed toner images 2, 4, 6, 8, is deposited by electrostatics onto the primary transfer belt 12. The electrostatic process can be accomplished by giving an electrostatic charge to a photosensitive surface of an image-forming member, such as the surface of a rotating drum, located at each image forming station 18, 20, 22, 24, and the charged surface is image-wise exposed to form a charged latent image which is then developed with particulate toner. The so-formed developed toner image is then electrostatically transferred from the drum surface to the primary transfer belt 12. The operation of the image-forming stations 18, 20, 22, 24 is controlled in such a manner as to ensure that the plurality of developed toner images 2, 4, 6, 8 are deposited on the primary transfer belt 12 in register with each other. Downstream of the image forming stations 18, 20, 22, 24, the primary transfer belt 12 contacts the fixing member 50 at the transfer station 16.

Figure 2:
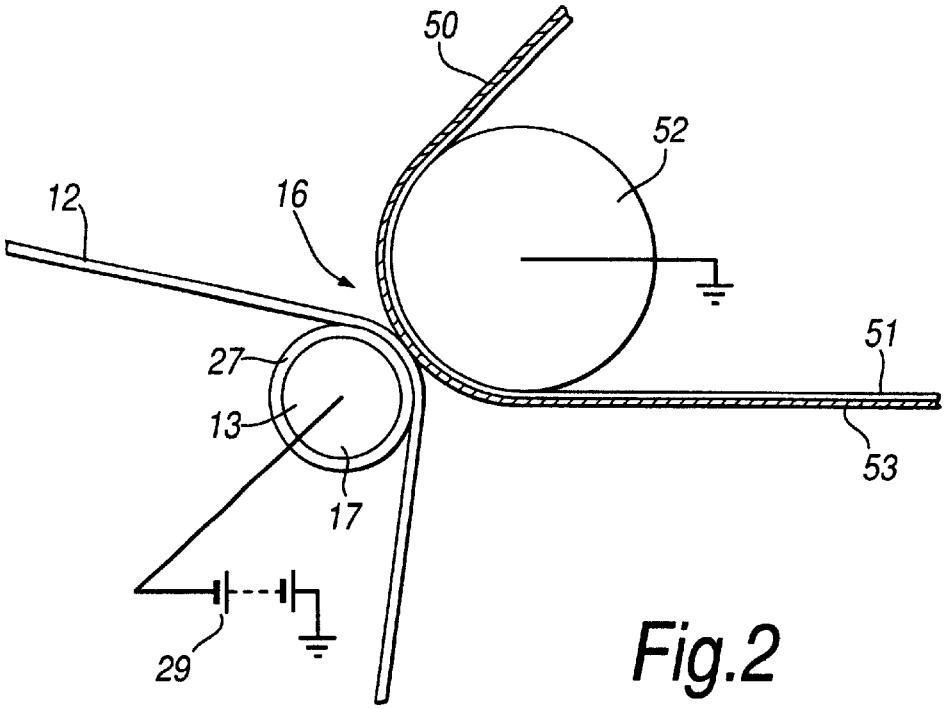
FIG. 2 is a cross-sectional view of the nip contact of FIG. 1.

Referring to FIG. 2, the fixing member 50 may be formed with an electrically conductive metal backing 51 having a thickness of between 50 and 150 $\mu$m, such as 75 $\mu$m stainless steel or 100 $\mu$m nickel. The backing may have a 80 $\mu$m surface covering 53 formed of silicone elastomer which has a low surface energy material, relative to the surface of the primary transfer belt 12 and of the substrate 58. The elastomeric outer layer enables the fixing member 50 to exert a pressure against a counter member 70 at the fixing nip 26 which is optimum for the fixing of the toner particle image 14. In alternate embodiments of the invention, the fixing member 50 may be in the form of a drum or in the form of a fixing belt. In the case where the fixing member 50 is a belt, this belt preferably comprises an electrically conductive backing member covered with e.g. a silicone elastomer, polytetrafluoroethylene, fluorsilicones, polyfluoralkylene or other fluorinated polymers. Above this covering, a semi-insulating or insulating coating layer, such as a fluorsilicone, may be formed. Alternatively, an optionally reinforced fabric backing may be used covered with a conductive, optionally conformable, silicone layer, optionally covered with a top coating.

Now referring to FIGS. 1 and 2, the primary transfer belt 12 passes over a number of guide rollers, including a nip-forming guide roller 13 and a drive roller 15 driven by a motor 28. The intermediate transfer nip 16 is defined by the guide roller 13 and a guide roller 52 being pressed against each other while the transfer belts are fed between them. As seen more clearly in FIG. 2, the intermediate transfer nip 16 is formed between the guide roller 13 and the opposing guide roller 52 pressed towards each other to cause tangential contact between the primary transfer belt 12 and the fixing member 50. The biased first guide roller 13 preferably comprises an electrically conductive core 17 carrying a semi-insulating covering 27. The core 17 may be formed of a metal such as aluminum, copper, or steel and the semi-insulating cover 27 may be formed of a silicone rubber. Preferably the first guide roller 13 is a cylindrical roller. A supply 29 of electrical potential is provided for electrically biasing the first guide roller 13 to create the electrical field at the intermediate transfer nip 16 to assist in transferring the toner image 14 from the primary transfer belt 12 to the fixing member 50. The second guide roller 52 comprises at least a conductive core, formed for example of aluminum.

Referring back to FIG. 1, a cooling device 68 may be provided to cool the primary transfer belt 12 downstream of the intermediate transfer nip 16 to assist in establishing the temperature gradient at the intermediate transfer nip 16. The primary transfer belt 12 may be forcibly cooled by contact with a cooled body and/or by directing a cooled medium onto the primary transfer belt 12.

A cleaning device 46 may be provided for cleaning the primary transfer belt 12, preferably located downstream of the cooling device 68. The cleaning device 46 may be, for example, in the form of a counter-rotating cleaning brush with vacuum pick-up. This cleaning removes any last traces of residual toner, substrate fibers and other contaminants from the primary transfer belt 12. By cleaning the primary transfer belt 12 after the cooling thereof, it is ensured that any residual toner is in a non-tacky state and thereby more easily removed.

The fixing member 50 is driven by a motor 56 continuously in turn through the intermediate transfer nip 16, over a heated roller 66 through the final fixing nip 26. The heated roller 66 is positioned after the intermediate transfer nip 16 and before the final fixing nip 26.

Downstream of the intermediate transfer nip 16, fixing member 50 further contacts the substrate at the fixing nip 26. This fixing nip 26 comprises a nip formed between a guide roller 54 of the fixing member 50 and the counter roller 70, through which nip the fixing member 50 and the substrate 58 in the form of a media web pass in intimate contact with each other. Drive rollers 62, driven by a motor 30, drive the substrate or web 58 in the direction of the arrow C from a supply roll 60 continuously through the fixing nip 26 where it is pressed against the fixing member 50 by the counter roller 70.

In one embodiment, unfixed toner particles in image form are carried on the fixing member 50 and are transferred to the receiving material 58 and fixed thereon as the receiving material 58 passes through the fixing nip 26. The unfixed toner particles may be deposited upon the fixing member 50 by any means known in the art, such as described in U.S. Pat. No. 5,805,967 (De Bock et al./Xeikon NV).

In another embodiment, unfixed toner particles in image form are carried on the receiving material 58 and are fixed thereon as the receiving material 58 passes through the fixing nip 26. The unfixed toner particles may be deposited upon the receiving material 58 by any means known in the art, such as described in U.S. Pat. No. 5,455,668 (De Bock et al./Xeikon NV).

Still referring to FIG. 1, a cleaning roller 73 is located downstream of the fixing nip 26 and upstream of any intermediate transfer region 16 where developed toner images 14 are deposited upon the fixing member 50, whether that be directly from a photoreceptor or indirectly by way of one or more further transfer members 12.

When the fixing member 50 is in the form of a belt, the cleaning roller 73 suitably cooperates with a backing roller 77 to form a cleaning nip 78 through which the fixing belt 50 passes. The rotation axis of the backing roller 77 is preferably perpendicular to the propagation direction of the belt 50. Means are preferably provided to adjust the pressure exerted between the cleaning roller 73 and the backing roller 77 at the cleaning nip 26. Alternatively, the required pressure may be derived from the geometry of the arrangement, the fixing belt 50 wrapping partially around the cleaning roller 73. In this case, a backing roller 77 may not be necessary.

Figure 3:
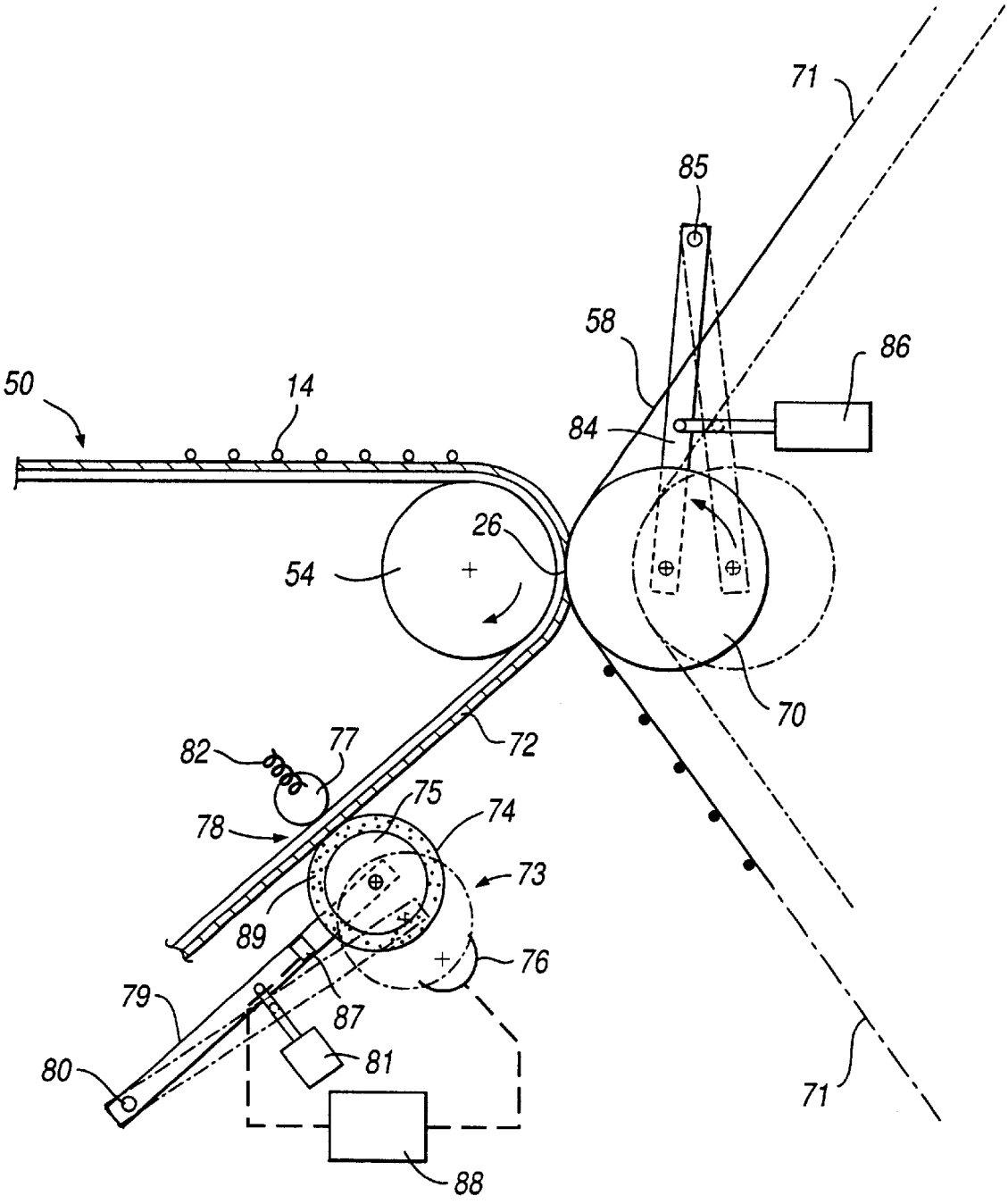
FIG. 3 is a cross-sectional view of the fixing device of FIG. 1.

Referring to FIG. 3, the cleaning roller 73 may comprise an inner core 75. Optionally a conformable layer 89 is provided thereon. A tacky surface layer 74 is formed on the inner core 75 or on the conformable layer 89 if present. The decision whether or not to provide a conformable layer 89 depends on the conformability of the fixing member 50. The conformable covering 89 preferably has a hardness of less than 80, most preferably less than 70, Shore A and a thickness of at least 1.0 mm, most preferably at least 2.0 mm. These requirements enable the cleaning roller 73 to exert a pressure on the fixing member 50, which is optimum for the removal of debris therefrom. Conductive fillers may be included in the conformable covering 89 of the cleaning roller 73 to control the electrical resistance thereof.

The cleaning roller tacky surface 74 is adapted to collect contaminants 100 from the fixing member 50. These contaminants are picked up by the tacky surface 74 and become embedded therein. Over time, these contaminants 100 would negatively influence the adhesive and absorptive properties of the tacky surface 74 and cause a deterioration of the cleaning performance. It is therefore necessary to maintain the cleaning ability of the cleaning roller 73 by the provision of fresh cleaning material 99 to the cleaning roller surface 74.

Figure 4:
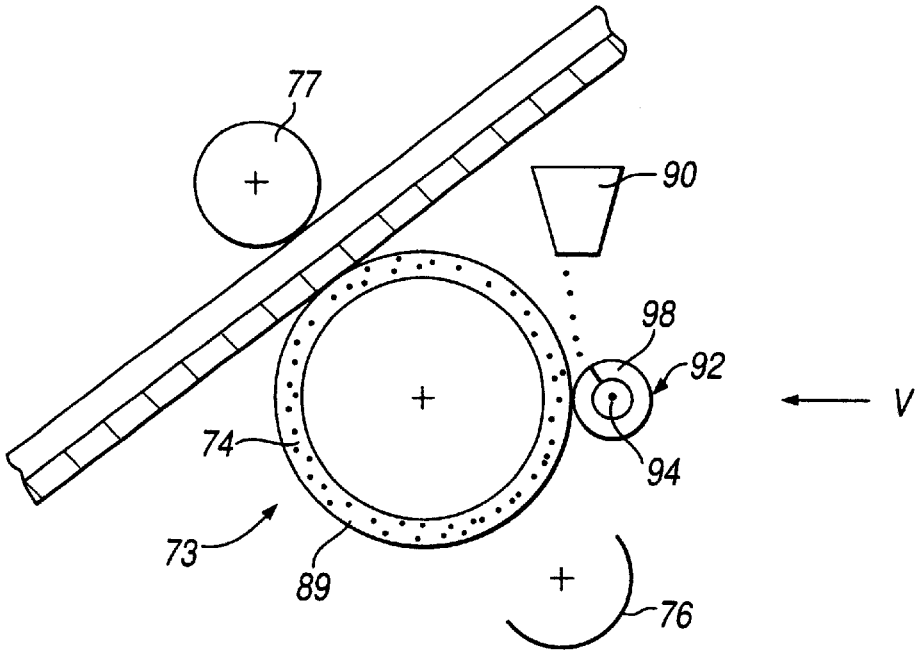
FIG. 4 is an enlarged view of the cleaning roller of the fixing device shown in FIG. 3.
Figure 5:
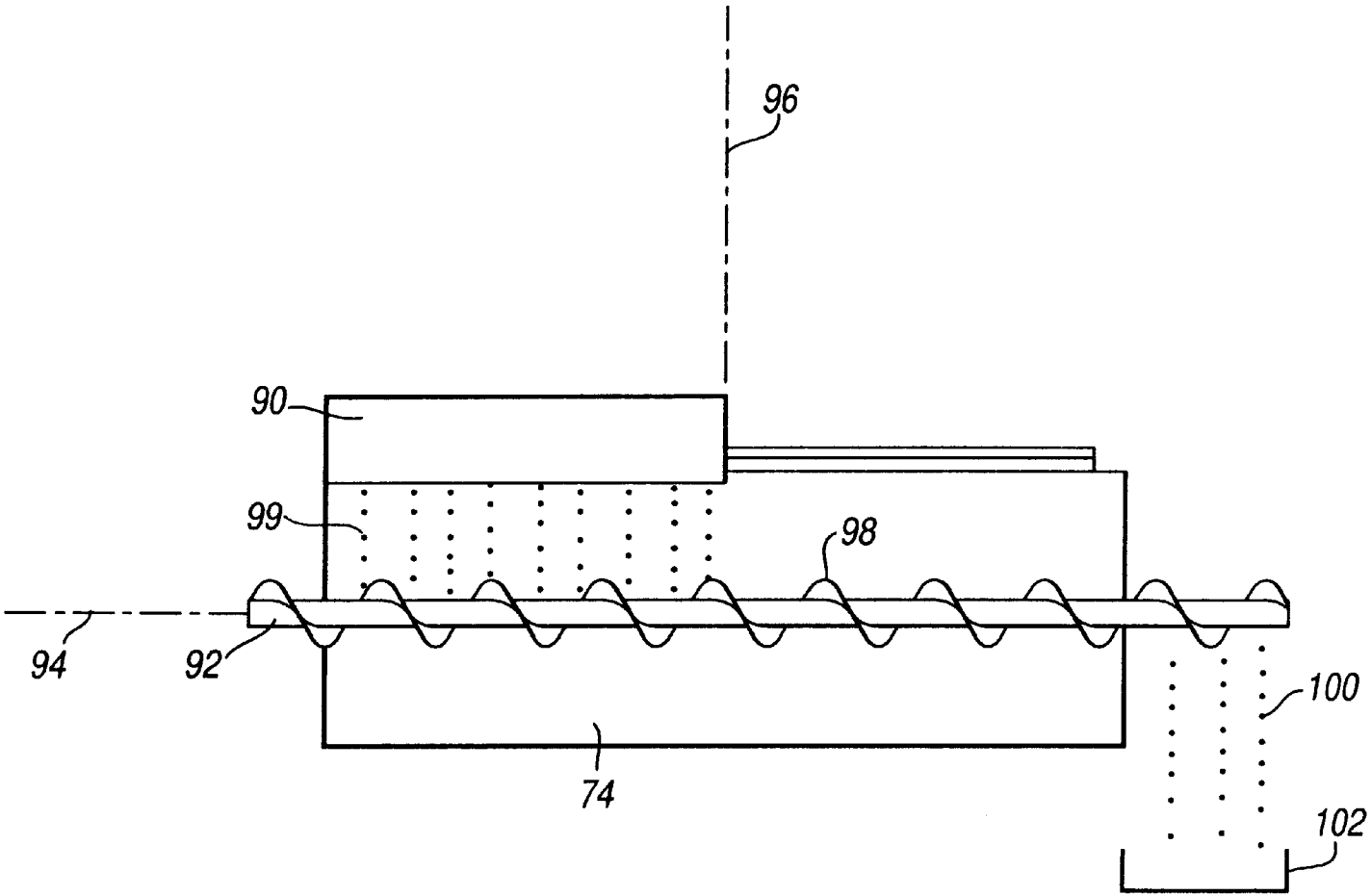
FIG. 5 is a side view of FIG. 4 taken in the "V" direction.

Referring to FIGS. 4 and 5, a spindle 92, which is preferably a helical spindle has an important role in the cleaning arrangement. Firstly, this spindle 92 transports fresh cleaning material 99 over the entire length of the cleaning roller 73 to get a uniform distribution of the fresh cleaning material 99 as well as a uniform mixing of the fresh cleaning material 99 with the contaminated tacky surface material 100. Moreover the spindle 92 also transports excess contaminated tacky surface material 100 to the edge of the cleaning roller 73 where it can be removed or collected in a waste unit 102. The transportation and mixing of the surface material is improved with the heating of the surface layer to thereby reduce the viscosity of the fresh cleaning material 99.

The transportation of the fresh cleaning material 99 or excess (contaminated) tacky surface material 100 can be further enhanced by introducing an angle between the rotation axis of the cleaning roller 73 and a propagation direction 96 of the fixing member 50 which is slightly different from 90 degrees. By introducing such an angle, a lateral displacement force is exerted on the excess tacky surface material 100 in the cleaning nip 78 zone. The size of this angle is dependent on the desired lateral transportation direction. In one embodiment, an spindle axis 94 lies at an angle of between 80° and 100°, most preferably between 88° and 92°, of the propagation direction 96 of the fixing member 50, whereas the spindle 92 and the cleaning roller 73 are preferably mounted in parallel. In another embodiment, the spindle 92 is in contact with the cleaning roller surface 74 across the whole width thereof.

The spindle 92 preferably has a constant diameter along its length. The spindle 92 may comprise a single continuous thread 98. In one embodiment, the properties of the revolving spindle 92 are selected such as to obtain a predetermined lateral speed of the cleaning material. Some of these properties are: a thread depth of from 2 to 20 mm, a ratio between the diameter of the cleaning roller 73 and the diameter of the spindle 92 of from 10:1 to 1:1 and a pitch of from 10 mm to 200 mm. The spindle 92 may have a negative, a positive, or a negative and a positive pitch. In the latter case, the transportation of the fresh cleaning material 99 or excess contaminated tacky surface 100 may be executed to both the edges of the cleaning roller 73 where the waste material can be collected.

Referring back to FIGS. 3 and 4, the tackiness of the surface layer 74 can be improved and the viscosity of the layer may be adjusted by heating the surface layer upstream of the cleaning nip 78. In one embodiment, the invention further comprises a heating device 76 for heating the cleaning material on the cleaning roller surface 74 to render the surface tacky prior to contact thereof with a fixing member surface 72. The heating device 76 may be in the form of a lamp located in the hollow core 75 of the roller 73.

When the cleaning roller 73 has a conformable surface, external heating is preferred, for example by use of an external radiant heat source, for example at, or close to the contact between the spindle 92 and the cleaning roller 73. Such an option is preferred to that of heating the interior of the cleaning member 73, since it is thereby possible to more accurately control the temperature of the cleaning member surface 74.

As shown clearly in FIG. 3, means are provided for controlling the heating of the toner particles, for example by the use of a heat sensor 87 to sense the temperature of the cleaning member surface 74, this sensor 87 being coupled to a control device 88 for the heating device 76. Heating the toner particles on the cleaning roller surface 74 has several benefits. The heating device 76 can be energized selectively to control the temperature and tackiness of the cleaning roller surface 74. This is especially beneficial at start up where, in the absence the heating device 76, it would take a significant amount of time (and possibly wastage of receiving material) before temperature equilibrium would be reached. Heating of the surface layer can be avoided if the polymer has a glass transition temperature of about room temperature or below. An electrical bias between the surface of the cleaning roller 74 and the fixing member 50 may be employed to assist removal of debris from the fixing member 50.

Referring back to FIG. 4, the device further comprises an applicator unit 90 for applying the fresh cleaning material (e.g. in powder form) 99 to the cleaning roller 73. This applicator unit 90 is preferably positioned immediately downstream of the cleaning nip 78 and prior to, or simultaneously with, the contact between the spindle 92 and the cleaning roller 73. The applicator unit 90 may be a simple dosing unit, which is able to supply fresh cleaning material 99 at a controllable rate and dose. These properties can be chosen dependent on the amount of contaminants 100 on the fixing member 50. As illustrated on FIG. 5, the applicator unit 90 may provide fresh cleaning material 99 locally or over the entire length of the cleaning roller 73 (i.e. parallel with the rotation axis of the cleaning roller).

The tacky surface 74 layer can be formed of polymeric material having good adhesive and adsorptive properties, especially at the operating temperatures of the fixing member 50. The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. The glass transition temperature (softening point) of the toner composition is preferably between 50° C. and 70° C., such as about 55° C. and a melting point (fluid point), at which the viscosity falls below 500 Pa s, is within the range of 90° to 155° C., such as 120° C. to 150° C. In one embodiment, the cleaning material 99 is preferably selected from polymers having a glass transition temperature below the temperature of the fixing member 50 at the cleaning nip 78.

The cleaning material 99 can also be a layer of toner particles. The toner particles which are applied to the cleaning member 73 to form the tacky surface 74 thereon, may have the same composition as the toner particles which form the image 14 to be fixed on the receiving member 58. The toner particles used in the present invention can be of any suitable form with respect to their composition, shape, size and method of preparation and the sign of their triboelectrically acquired charge. Dry-development toners typically comprise a thermoplastic binder consisting of a thermoplastic resin or mixture of resins including coloring matter, e.g. carbon black or coloring material such as finely dispersed pigments or soluble dyes.

While the toner particles applied to the cleaning member 73 may be the same as those used for forming the toner particle image 14, it is also possible to use toner particles of a different composition, for example containing a lower level of pigment, or even no pigment at all. However, where the pigment is, or includes, carbon black, this leads to an advantage with respect to the adsorption of molecular contaminants and for this reason toner particles containing carbon black, especially higher than usual levels of carbon black, are preferred. When the fresh cleaning material 99 is fresh toner, the applicator unit 90 may be of similar construction as, or be fed with toner from, the toner applicator unit of an image-forming station of the printer 18, 20, 22, 24.

In one embodiment, the cleaning roller 73 may be selectively movable into and out-of a cleaning position in which the cleaning roller surface 74 is in contact with the fixing member surface 50. In still another embodiment, the cleaning roller 73 and the spindle 92, and also the backing roller 77 when provided, can each be removably mounted and may be independently driven. Alternately, these items can be driven by the movement of the fixing member 50.

In operation, the plurality of developed toner images 2, 4, 6, 8 are electrostatically deposited in register with each other onto the primary transfer belt 12 at the image-forming stations 18, 20, 22, 24 to form the multiple toner image 14 on the primary transfer belt 12. The primary transfer belt 12 carrying the multiple toner image 14 contacts the heated fixing member 50 at the intermediate transfer nip 16 to electrostatically transfer the multiple toner image 14 to the fixing member 50. The pressure exerted between the first guide roller 13 and the second guide roller 52 at the intermediate transfer nip 16 is about 100 N.

The fixing member 50, with the multiple toner image carried thereon, is heated by heated roller 66 to a temperature of between 80° and 150° C., such as about 115° C., thereby to render the multiple toner image tacky. The fixing member 50 carrying the tacky multiple toner image 14 then contacts the web 58 at the fixing nip 26 to transfer the multiple toner image 14 thereto. The fixing member 50 is then brought into further contact with the primary transfer belt 12 while the fixing member 50 is at an elevated temperature to establish a temperature gradient at said intermediate transfer nip 16. The temperature of the fixing member 50 immediately upstream of said intermediate transfer nip 16 is preferentially about 105° C., the temperature of the primary belt 12 immediately upstream of said intermediate transfer nip 16, is preferentially about 35° C. The temperature of the fixing member 50 falls only slightly as the belt passes through the nip 16, with the result that immediately upstream of the heating device 66 the temperature is about 100° C. The heating device 66 need only raise the temperature of the intermediate transfer belt by about 15 Centigrade degrees to bring the toner image thereon to the required temperature for final transfer.

The primary transfer belt 12 is forcibly cooled at the cooling station 68 by directing cooled air onto the primary transfer belt 12. The primary transfer belt 12 is thereby cooled to the temperature of about 35° C. This cooling assists in establishing the required temperature gradient at the intermediate transfer nip 16. In addition, the primary transfer belt 12 is cleaned at cleaning station 46 before the deposition of further developed toner images 2, 4, 6, 8.

FIGS. 3 and 4 show the device for simultaneously transferring and fixing toner images onto the paper web 58. The fixing member 50 is urged into contact with the counter roller 70 to form the fixing nip 26 there between through which a path 71 for the paper web 58 extends. Unfixed toner particles 14, which have been deposited onto the fixing member 50 in image form by the printer upstream of the fixing nip 26, are transferred to the paper web 58 and fixed thereon as the paper web 58 passes through the fixing nip 26. The fixing member 50 has a dry elastomeric outer layer, the surface 72 of which is coated with a silicone material and passes over the heated support roller 54 at the fixing nip 26.

A cleaning roller 73 has its surface 74 in rolling contact with the surface 72 of the fixing member 50 to remove contaminants (including residual toner) therefrom. The cleaning roller 73 comprises the rigid metal core 75 provided with the conformable EPDM covering 89. The conformable covering has a hardness of 60 Shore A and a thickness of 5 mm. The radiant heater 76 is positioned adjacent to the cleaning roller 73.

The cleaning roller 73 co-operates with the metal backing roller 77 to form the cleaning nip 78 there between through which fixing member 50 passes, downstream of the fixing nip 26. The cleaning roller 73 is carried on supporting arms 79 which can be pivoted about a pivot point 80 by operation of a solenoid 81 to normally position the cleaning roller 73 to contact the surface 72 of fixing member 50. An adjustable spring 82 is provided to adjust the pressure exerted between the cleaning roller 73 and the backing roller 77 at the cleaning nip 78. In place of the spring 82, adjustment of the nip pressure may be achieved by control of the solenoid 8 1.

The counter roller 70 is carried on supporting arms 84 which can be pivoted about a pivot point 85 by operation of a solenoid 86 to enable the counter roller 70, from time to time, to be moved in a direction away from the fixing member 50 to the position shown in broken lines in FIG. 3 to open the fixing nip 26.

As shown in FIGS. 4 and 5, the controllable applicator unit 90 continuously provides fresh cleaning material 99 in powder form to the cleaning roller 73 to rejuvenate the tacky surface 74. The applicator unit 90 is positioned immediately downstream of the cleaning nip 78. The applicator unit 90 is a simple dosing unit which is able to supply fresh cleaning material at a controllable rate and dose over approximately half the width of the cleaning roller 73.

The cleaning material is, for example, toner in which carbon black is used as a pigment, the toner having a glass transition temperature of about 55° C., that is below the temperature of the fixing member 50 at the cleaning nip 78.

The spindle 92 is positioned immediately downstream of the applicator unit 90 and contacts the cleaning roller surface 74 across the whole width thereof. The spindle 92 has a constant overall diameter of 30 mm along its length. The thread depth is 10 mm, while the ratio of the diameter of the cleaning roller and the diameter of the spindle is 3:1. The spindle 92 transports the fresh cleaning material 99 from the applicator unit 90 across the roller 73 and transports the contaminated tacky cleaning material 100 towards an edge of the cleaning roller 73, where it falls into the collecting tray 102. The axis 94 of the spindle 92 lies parallel to that of the cleaning roller 73, while both are at an angle of about 95° to the propagation direction 96 of the fixing member 50, further enhancing the transportation of the fresh cleaning material 99 and contaminated tacky surface material 100.

The heating device 76 heats the cleaning material on the cleaning roller surface 74 adjacent the spindle 92 to render the surface 74 tacky prior to contact thereof with the fixing member surface 72. The temperature of the cleaning material on the cleaning roller surface 74 is sensed by the temperature sensor 87, which generates signals to the control device 88 for controlling the output of the heating device 76. The cleaning roller 73 and the spindle 92 are each independently driven by drive motors (not shown).

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A fixing device for fixing toner images onto a recording medium, said device comprising:

an endless fixing member urged into contact with an endless counter member to form a fixing nip there between through which a recording medium path extends;

a cleaning roller having a surface in contact with the surface of said fixing member downstream of said fixing nip, said surface carrying a layer of tacky cleaning material;

a controllable applicator unit for continuously providing fresh cleaning material to said cleaning roller; and a spindle contacting said cleaning roller surface for transporting said fresh cleaning material from said applicator unit across said roller and for transporting said contaminated tacky cleaning material towards an edge of said cleaning roller.

2. A fixing device according to claim 1, further comprising a heating device for heating said cleaning material on said cleaning roller surface to render said surface tacky prior to contact thereof with said fixing member surface.

3. A fixing device according to claim 1, wherein said fixing member is in the form of a fixing belt and said cleaning roller cooperates with a backing roller to form a cleaning nip through which said fixing belt passes.

4. A fixing device according to claim 1, wherein said cleaning roller is selectively movable into and out-of a cleaning position in which said cleaning roller surface is in contact with said fixing member surface.

5. A fixing device according to claim 1, wherein the axis of said spindle lies at an angle of between 80° and 100° of the propagation direction of said fixing member.

6. A fixing device according to claim 1, wherein said spindle is in contact with said cleaning roller surface across the whole width thereof.

7. A fixing device according to claim 1, wherein the ratio of the diameter of said cleaning roller and the diameter of said spindle is from 10:1 to 1:1.

8. A method of removing contaminants from the surface of an endless fixing member of a fixing device in which said fixing member is urged into contact with a counter member to form a fixing nip there between through which the recording medium passes, the method comprising:

contacting said fixing member surface at a cleaning nip with a cleaning roller having a tacky surface layer of cleaning material, thereby to transfer contaminants from said fixing member to said tacky surface;

continuously applying fresh cleaning material to said cleaning roller to rejuvenate said tacky surface; and contacting said cleaning roller surface with a revolving spindle to distribute said fresh cleaning material across said cleaning roller and to transport said contaminated cleaning material to an edge of said cleaning roller.

9. A method according to claim 8, wherein said cleaning material is selected from polymers having a glass transition temperature below the temperature of said fixing member at said cleaning nip.

10. A method according to claim 8, wherein said cleaning roller and said spindle are each independently driven.

* * * * *